United States Patent [19]

Dry

[11] 4,014,253

[45] Mar. 29, 1977

[54] ADJUSTABLE DIFFUSERS

[75] Inventor: Hal Dry, Winters, Tex.

[73] Assignee: Wallace-Murray Corporation, New York, N.Y.

[22] Filed: Nov. 14, 1975

[21] Appl. No.: 631,887

[52] U.S. Cl. ..... 98/121 A; 49/74; 49/88; 137/601

[51] Int. Cl.[2] ..... F24F 13/08

[58] Field of Search ..... 98/40 VM, 110, 121 R, 98/121 A; 137/601; 49/73, 74, 87, 88

[56] References Cited

UNITED STATES PATENTS

| | | | |
|---|---|---|---|
| 2,751,154 | 6/1956 | Valtersson et al. | 98/110 X |
| 3,196,895 | 7/1965 | Dayus | 137/601 X |
| 3,358,577 | 12/1967 | Thomson | 98/40 VM |
| 3,500,739 | 3/1970 | Dry | 98/121 R X |
| 3,720,154 | 3/1973 | Biggi | 98/110 |
| 3,741,102 | 6/1973 | Kaiser | 98/110 |

*Primary Examiner*—Ronald C. Capossela
*Attorney, Agent, or Firm*—Carl B. Fox, Jr.

[57] ABSTRACT

Adjustable diffusers of the type employed for control of flow of air into or out of a space. The diffusers according to the invention have a louvered face plate and have plural parallel vanes behind the face plate each movable between closed and opened positions. The diffusers have interchangeable control plates which have J-slots to control the vane positions and by substitution of which the directions of rotations of the vanes may be altered. The diffusers are of simplified design as compared with present commercially available diffusers.

8 Claims, 7 Drawing Figures

Fig. 3
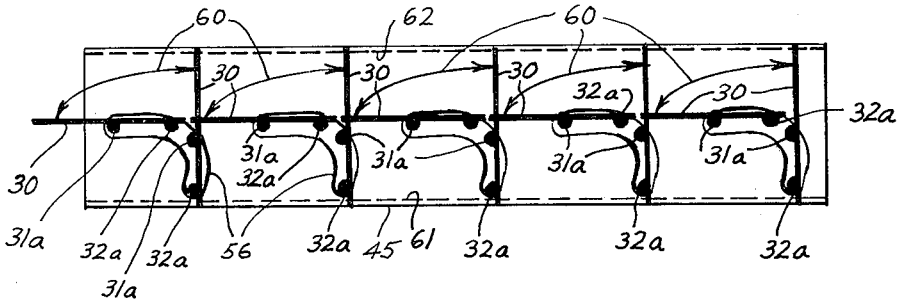
Fig. 4
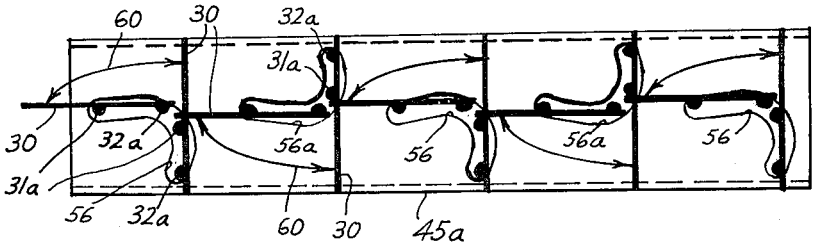
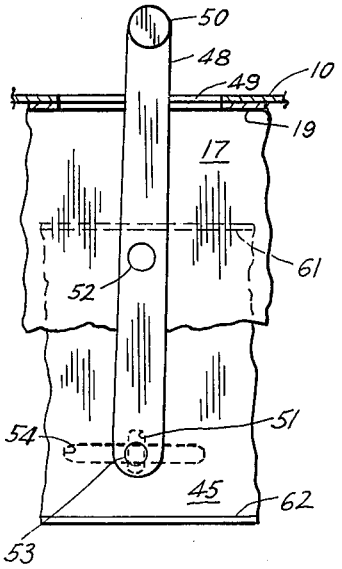
Fig. 7
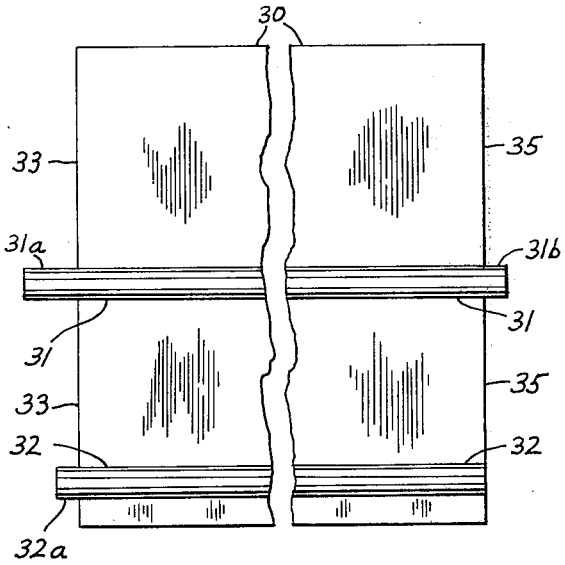
Fig. 5
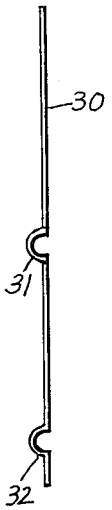
Fig. 6

ADJUSTABLE DIFFUSERS

BACKGROUND OF THE INVENTION

Diffusers of the type having closeable and openable vanes have been somewhat expensive to manufacture because of the number of parts required for their operation. Such diffusers have universally been made with the vanes having rotation in the same direction between their open and closed positions. In such structures, when the vanes are partly opened, the vanes have air directing dispositions which will cause air flow to be diverted in the direction of the vanes. In situations where it is desired to eliminate the air directing feature, alternate vanes must be rotated in opposite directions in order that air direction by the vanes will not occur.

SUMMARY OF THE INVENTION

According to the invention, adjustable diffusers are provided wherein the vanes may be rotated in either direction, selectively as desired. The modification of vane rotation is accomplished by modification of only one part, a control plate which directs the vanes in their rotations between opened and closed positions. According to the present invention, control plates having altered J-slots may be substituted to provide vane rotations as desired. This is a principal advantage of the invention.

The diffuser structure afforded by the invention will result in savings in manufacturing costs and will result in simplicity of assembly of the diffusers.

A principal object of the invention is to provide diffusers of improved design. Another object of the invention is to provide such diffusers which have air flow control vanes the rotations of which may be reversed. A further object of the invention is to provide such diffusers which are simple and economical, yet are entirely reliable in use.

Other objects and advantages of the invention will appear from the following detailed description of preferred embodiments thereof, reference being made to the accompanying drawings.

BRIEF DESCRIPTIONS OF THE DRAWINGS

FIGS. 3 and 4 are schematic drawings indicating the manner of providing alterations of the directions of vane rotation according to the invention.

FIG. 5 is a front elevation of a vane of preferred form according to the invention.

FIG. 6 is an end view of the vane shown in FIG. 5.

FIG. 7 is a partial cross sectional view taken at line 7—7 of FIG. 2.

DESCRIPTION OF THE PREFERRED EMBODIMENTS

Figure 1:
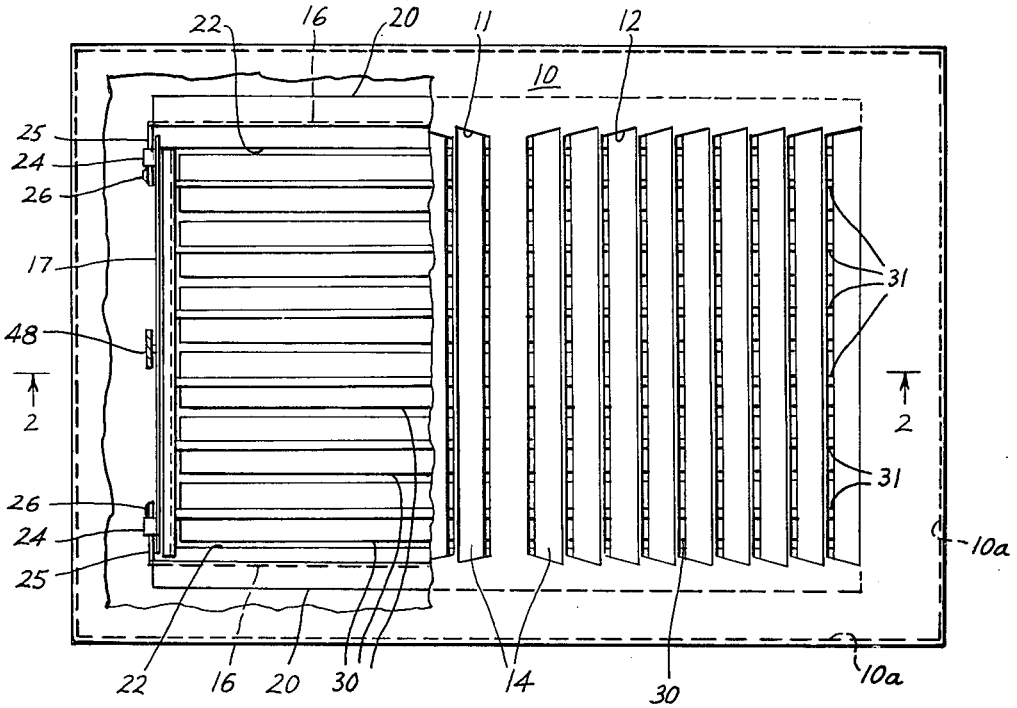
FIG. 1 is a front elevation of a diffuser of preferred form according to the invention, part of the face plate being shown cut away.

Referring now to the drawings in detail, the diffusers have a face plate 10 having louvered openings 11, 12 formed therein by making cuts in the face plate and bending the louver vanes 14 to angular positions as shown. Plate 10 has an inward flange 10*a* therearound. The arrangement and form of the louvers is not part of this invention, and a face plate having louvers of any forms and directions may be substituted.

A diffuser housing is formed by face plate 10 and identical opposite side panels 16 and end panels 17, 18. The side and end panels 16 and 17–18 have outturned inner edge flange portions 19 and 20, 21, respectively, which are connected to the back side of face plate 10 by tack welding or other suitable connection. The side panels 16 have inturned outer edge flange portions 22 adjacent the locations of the vane edges when the vanes are in closed positions, and the side panels are narrower than end panels 17, 18. The side panels are connected to the end panels by snap connections afforded by upset strips 24 in panels 17, 18 beneath which transversely bent strip portions 25 at the ends of panels 16 are releasably disposed, the strip portions 25 having upset portions 26 serving as detents to maintain the strip portions within the slots afforded by outwardly upset strips 24.

Figure 2:
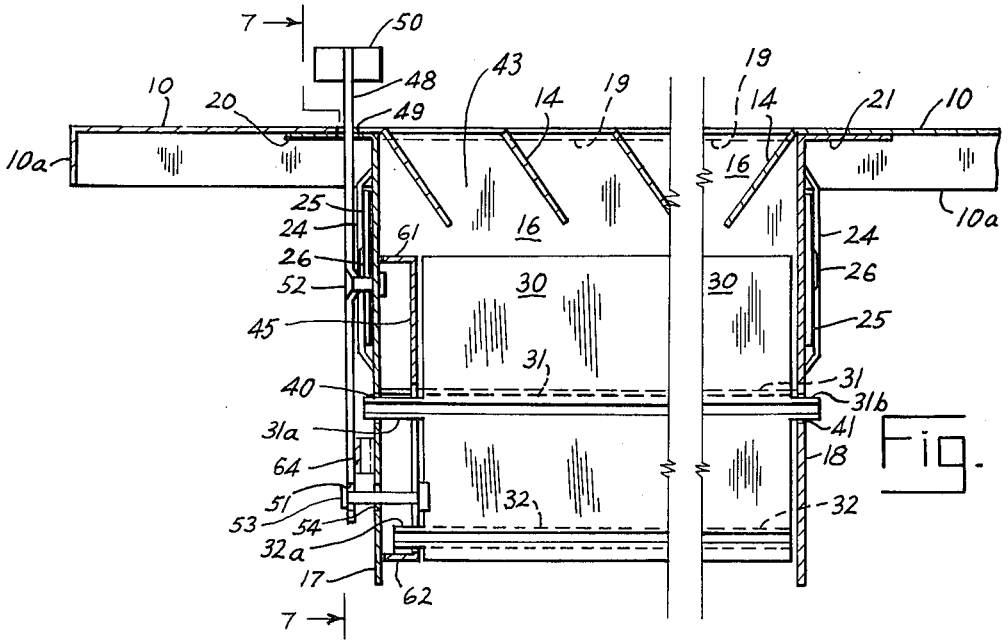
FIG. 2 is a transverse cross section taken at line 2—2 of FIG. 1.

The vanes 30, any number of which may be provided, are in the form of flat metal plates having upset rib formations 31, 32. At end 33 of each vane 30, the rib 32 extends outwardly at 32*a* to a lesser distance than rib extension 31*a*. At end 35 of each vane, the rib 31 extends outwardly by the lesser distance shown at 31*b*, while rib 32 is flush with the vane end. The extending rib formations serve as pivots for connections of the vanes to the diffuser housing. Referring especially to FIG. 2, the rib formation 31*a* of each vane extends through a circular opening 40 in panel 17, and the rib formation 31*b* extends through a circular opening 41 in panel 18. The openings 40, 41 are arranged in straight lines along the lengths of panels 17, 18, and are spaced apart so that the vanes 30 when closed will have their edges adjacent one to another to substantially close the flow passage 43 through the diffuser housing.

Inwardly of panel 17, there is provided a movable control plate 45 which has a plurality of spaced J-slots therethrough as indicated in FIG. 3 or 4. Control plate 45 is mounted freely for movement longitudinally as will later become more clear. Control plate 45 is loosely supported by rib formations 31*a* engaged through the J-slots thereof. A bar 48 extends through a slot 49 formed through face plate 10 and flange 20. The slot 49 is elongated transversely of the diffuser to enable pivotal movement of bar 48 parallel with panel 17. Bar 48 has at its outer end in front of face plate 10 a finger engagement handle 50 of any desired design. Bar 48 is pivotally connected to panel 17 by connection pin or rivet 52. The lower end of bar 48 is connected by connection pin 53 through slot 51 to control plate 45, the pin 53 extending through a slot 54 formed through panel 17. Slot 54 enables pivotal movement of pin 53 and longitudinal movement of control plate 45.

Referring now to FIG. 3 of the drawings, control plate 45 has therethrough a plurality of spaced J-slots 56, five being shown in FIG. 3. The diffuser shown in FIG. 1 has six vanes 30, so that the control plate for that diffuser assembly would have six slots 56 instead of five. As previously stated, the number of vanes may be selected at will, so that any desired number may be employed.

In considering FIG. 3 of the drawings, and also FIG. 4, it must be remembered that the control plate 45 is moved longitudinally during the vane movements to be discussed, so that the vanes remain with their ribs 31 in fixed positions in holes 40, 41 of panels 17, 18, respectively. The control plates 45 also may move somewhat vertically, as a result of loose fit of ribs 31*a*, 31*b* in holes 40, 41. The control plate is moved longitudinally by movement of bar 48 about pivot pin 52. When control plate 45 is moved, the ribs 31*a*, 31*b* rotate in the circular openings 40, 41 of respective panel 17 and 18. The vanes are moved in rotative movement by the guidance afforded by ribs 32*a* in J-slots 56 of the control plates. The control plate 45 moves, on vane opening, toward the left as the control plate and vanes are shown in FIG. 3, the ribs 32*a* being moved downwardly in the slots while the ribs 31*a* move generally horizontally in the slots. The arrows 60 indicate the rotative vane movements. Upon movement of the vanes 30 to closed, or horizontal, positions, the control plate 45 is moved toward the right, this moving the ribs 32*a* to elevated positions in the J-slots. In the FIG. 3 modification of the diffusers, the vanes all move in the same direction of rotation between opened and closed positions.

Referring now to FIG. 4 of the drawings, it will be noted that control plate 45*a* has a plurality of J-slots 56, two of which are in inverted dispositions 56*a*. The two inverted J-slots in control plate 45*a* will cause the vanes 30 engaged with those slots to be rotated in directions opposite the rotation of the other three vanes 30. Therefore, by merely substituting the control plate 45*a* for control plate 45, the rotations of two of the vanes is reversed.

The control plates 45 have opposite outturned edge flanges 61, 62 which space the central portion of the control plates from panel 17. This spacing permits ribs 32*a* to have sufficient length to dependably engage in the J-slots.

It will be apparent that the J-slots 56 may be in any suitable arrangements including not limited to those shown in FIGS. 3 and 4. For example, the three left hand J-slots could be in the position shown in FIG. 3, while the remaining two J-slots at the right hand side could be inverted to positions 56*a*. Any desired arrangements of the J-slots can be used. If the vanes open to positions of like angularity, the vanes guide air flow therebetween in the direction of the vanes. If the vanes open to positions of opposite angularity, then no directional air guiding results, and air flow is perpendicular to face plate 10.

The diffusers afforded by the invention are simple in construction yet entirely reliable in use. A ban spring 64 is shown connected to panel 17, bar 48 frictional engagement therewith. The spring 64 provides that bar 48 will remain in any position to which it is moved, so that the vanes 30 may be positioned at intermediate positions or at fully opened or closed positions as desired.

The improved diffusers are far simpler than diffusers of the same type according to conventional construction. The number of parts is reduced and the reliability of operation is improved.

While preferred embodiments of the invention have been described and shown in the drawings, many modifications thereof may be made by a person skilled in the art without departing from the spirit of the invention, and it is intended to protect by Letters Patent all forms of the invention falling within the scope of the following claims.

I claim:

1. Diffuser, comprising a plurality of side by side parallel vanes, each said vane having in line with the plane of the vane a longitudinal central pivot extending from an intermediate point of each of its ends, means for pivotally supporting each said vane at each of its said central pivots whereby said vane is rotatable about an axis defined by its said central pivots, said vanes each having at the same ends thereof and in line with the plane of the vane a longitudinal offset pivot shorter than the central pivot at that end of the vane, slotted plate means supported for reciprocal movements along the line of said same ends of said vanes, said slotted plate means having at the end of each vane a J-slot having a straight slot portion parallel to said line of said same ends of said vanes and having a hook-shaped slot portion at one end thereof, said central and offset pivots of said vanes being disposed slidably movably in said J-slots, means beyond the ends of said offset pivots for restraining each said central pivot against lateral movements, and means for reciprocatingly moving said slotted plate means to move said central and offset pivots of said vanes along said slots thereof and to move said offset pivots between said straight portions of the slots and the curved portions thereof to rotate said vanes between open and closed positions.

2. Diffuser, comprising a face plate having gas flow passage means therethrough, first and second end panels and first and second side panels connected at the back side of said face plate to form a rectilinear housing, plural vane means disposed parallel to said face plate and side panels and spaced along the lengths of said end panels and keyed at their ends to said end panels for rotation about their longitudinal centers to be rotatable between open and closed positions with respect to said gas flow passage means of said face plate, each said vane means having a longitudinally extending center pivot at one end thereof and having a shorter longitudinally extending spaced pivot spaced from said center pivot, said center and spaced pivots each being in line with the plane of the vane means whereby when said center and spaced pivots are moved to a different plane by movements of said center and spaced pivots along said slots with said spaced pivots being moved between the stem portions of the slots and the hook-shaped portions of the slots said plane of the vane means is moved to said different plane, plate means movably disposed parallely adjacent and inwardly of said first end panel and having J-slots each having a straight slot portion and a hook-shaped slot portion at one end thereof and each receiving said center pivot and said spaced pivot of said one end of one of said vane means, and means for controlling movements of said plate means to control rotation of said vane means between said open and closed positions.

3. The combination of claim 2, said J-slots having their stem portions aligned and having their hook-shaped portions extending transversely of said aligned stem portions.

4. The combination of claim 3, wherein said hook-shaped portions of said J-slots extend transversely in the same direction from said aligned stem portions of said J-slots, whereby said vane means rotate in one direction upon opening and in the opposite direction upon closing.

5. The combination of claim 3, wherein said hook shaped portions of one or more of said J-slots extend transversely from said aligned stem portions of said J-slots in the direction opposite the transverse extent of the remainder of said J-slots, whereby the vane means engaged with said oppositely extending J-slots rotate in the opposite direction with respect to the direction of rotation of the vane means keyed to the remainder of said J-slots upon opening and closing.

6. The combination of claim 3, said means for controlling movements of said plate means comprising lever means connected between said control means and said housing and extending to the front side of said face plate to be accessible to be moved by hand.

7. The combination of claim 6, including spring means mounted on said housing and slidably bearing against said lever means to retain said lever means in any position in which it is placed.

8. The combination of 3, wherein said center pivots comprise outwardly projecting extensions of upset rib formations along the longitudinal centers of said vane means, and wherein said spaced pivots comprise outwardly projecting extensions of upset rib formations adjacent one longitudinal edge of each said vane means.

* * * * *